US007207788B2

(12) United States Patent
Sato

(10) Patent No.: US 7,207,788 B2
(45) Date of Patent: Apr. 24, 2007

(54) LUBRICATION FEATURES FOR A SCROLL FLUID MACHINE

(75) Inventor: Toru Sato, Yokohama (JP)

(73) Assignee: Anest Iwata Corp. (JP)

( * ) Notice: Subject to any disclaimer, the term of this patent is extended or adjusted under 35 U.S.C. 154(b) by 33 days.

(21) Appl. No.: 11/089,239

(22) Filed: Mar. 24, 2005

(65) Prior Publication Data

US 2005/0220649 A1 Oct. 6, 2005

(30) Foreign Application Priority Data

Mar. 30, 2004 (JP) ..... 2004-099077

(51) Int. Cl.
*F04C 18/04* (2006.01)

(52) U.S. Cl. ..... 418/55.6; 384/474; 384/462; 418/92

(58) Field of Classification Search ..... 418/55.3, 418/55.6, 92, 55.1, 55.2, 55.5; 384/462, 384/474
See application file for complete search history.

(56) References Cited

U.S. PATENT DOCUMENTS 5,201,646 A * 4/1993 Dees et al. ..... 418/55.5
5,888,057 A * 3/1999 Kitano et al. ..... 418/55.2
2002/0136653 A1* 9/2002 Gennami et al. ..... 418/55.6
2003/0053922 A1* 3/2003 Satoh et al. ..... 418/55.1

FOREIGN PATENT DOCUMENTS

JP 7-2961 1/1995

* cited by examiner

*Primary Examiner*—Thomas E. Denion
*Assistant Examiner*—Mary A. Davis
(74) *Attorney, Agent, or Firm*—Ostrolenk, Faber, Gerb & Soffen, LLP

(57) ABSTRACT

A scroll fluid machine comprises a stationary scroll and an orbiting scroll between which a sealed space is formed. The orbiting scroll is eccentrically revolved with respect to the stationary scroll around a drive shaft via a bearing. An oil-supply hole is formed at the orbiting scroll so that grease may be supplied into the bearing for lubrication; There is a self rotation preventing device for the orbiting scroll and another oil supply hole to that device.

4 Claims, 2 Drawing Sheets

LUBRICATION FEATURES FOR A SCROLL FLUID MACHINE

BACKGROUND OF THE INVENTION

The present invention relates to a scroll fluid machine, such as a scroll compressor, a scroll vacuum pump, a scroll expander or a scroll blower.

Such a scroll fluid machine comprises a stationary scroll and an orbiting scroll which is supported on an eccentric shaft portion of a drive shaft to turn via a bearing. The stationary scroll comprises, a stationary end plate having a stationary wrap and the orbiting scroll comprises an orbiting end plate having an orbiting wrap. Between the stationary wrap and the orbiting wrap, a sealed chamber is formed and there is a self-rotation preventing device for preventing rotation of the orbiting scroll around its own axis.

With the eccentric shaft portion of the drive shaft and the self-rotation preventing device, the orbiting scroll is eccentrically revolved with respect to a stationary scroll. According to a direction of rotation, fluid sucked through the outer circumference is introduced into the center while being compressed, or fluid sucked from the center is depressurized and discharged from the outer circumference. The stationary and orbiting wraps comprise involute curves which gradually increase around its their center in a direction of rotation or comprise a curve comprising short arcs having a common center and being connected in a circumferential direction or comprise a combination thereof. A radial gap between the stationary and orbiting wraps is exactly determined so that wraps do not to engage with each other and to avoid significant increasing radial size of the gap.

DESCRIPTION OF A PRIOR ART EMBODIMENT

FIG. 2 shows a scroll compressor as one example of a scroll fluid machine, but the present invention may also be applied to other scroll fluid machine such as a scroll expander. In FIG. 2, the left side is front and the right side is rear.

A stationary scroll 1 in the front or left of FIG. 2 comprises a circular stationary end plate 4 having an inlet 2 on the outer circumference and an outlet 3 at the center. A spiral stationary wrap 5 is provided on the rear surface of the stationary end plate 4, and has a plurality of corrugated horizontal cooling fins 6 at regular intervals on the front surface.

The orbiting scroll 7 behind the stationary scroll 1 has a spiral orbiting wrap 9 on the front surface of a circular orbiting end plate 8 which faces the stationary scroll 1, and a plurality of corrugated horizontal cooling fins 10 at regular intervals on the rear surface.

A bearing plate 11 is disposed behind the orbiting scroll 7. At the center of the rear surface of the bearing plate 11, an eccentric shaft portion 13 of a drive shaft 12 is supported to turn by a tubular boss 15 via a roller bearing 14 and an oil seal 15*a*, and there are three known crank-pin-shaped self-rotation preventing devices 16 on the outer circumference so that the orbiting scroll 7 may eccentrically revolve around the drive shaft 12 in a housing 17.

The rear end of the drive shaft 12 projects from the housing 17 and is connected to a power-transmitting pulley 18 and a cooling fan 19 which is covered with a cover 20 secured to the rear surface of the housing 17. A cover plate 21 touches the front surface of the stationary scroll 1 and is fixed by a screw 22.

The orbiting scroll 7 is fixed to the bearing plate 11 by a screw 23. A rear plate 24 of the stationary scroll 1 is put on the front surface of the housing 17 and fastened by a bolt 25 and a nut 26.

Engagement grooves 5*a*,9*a* are formed on the ends of the stationary wrap 5 and the orbiting wrap 9. Sealing members "S" are put in the engagement grooves 5*a*,9*a* to assure sliding contact between the orbiting end plate 8 of the orbiting scroll 7 and the stationary end plate 4 of the stationary scroll 1.

In order to operate smoothly and to prevent excessive heat, grease is introduced in the bearing portions. However, with operation of the scroll fluid machine, grease in the bearings gradually evaporates or leaks with sliding heat of a rotational portion, so that it must be supplied periodically.

Thus, in the scroll fluid machine in FIG. 2, after removing the pulley 18, the cover 20 and the cooling fan 19, the cover plate 21, the stationary scroll 1, the orbiting scroll 7 and the bearing plate 11 must be disassembled by unfastening the screws 22, 23, the bolt 25 and the nut 26 to result in a lot of work and time.

To overcome the disadvantage, Japanese Utility Model Pub. No. 7-2961 has been proposed. In a scroll fluid machine in the publication, to supply grease into a bearing at the end of a crank shaft, an oil supply entrance is formed at the bottom of a balancing weight mounted to the crank shaft. A path which communicates with the oil supply entrance is connected to a slit to a bearing.

However, it is troublesome to handle the housing from the outside. To enable a grease gun to come closer toward the oil-supply entrance in the bottom of the balancing weight, it is necessary to detach a pulley from the end of the main driving crank shaft. It requires a lot of work. It is not so easy to bore the oil-supply entrance through the balancing weight or to bore the path which communicates with the entrance through the crank shaft.

Furthermore, in the utility model publication, to supply oil into a bearing of a driven crank shaft in a self-rotation preventing device for revolving the orbiting scroll eccentrically, an oil-supply hole and the path is bored axially and a grease nipple in the opening is covered with a cover.

Thus, it is difficult to bore the oil-supply hole and path in the housing, and it is necessary to remove the cover when grease is introduced.

SUMMARY OF THE INVENTION

In view of the foregoing disadvantages, it is an object of the invention to provide a scroll fluid machine which enables grease to be supplied into bearings of an eccentric shaft portion of a drive shaft and a self-rotation preventing device merely by removing a cover plate and a stationary scroll in the front.

BRIEF DESCRIPTION OF THE DRAWINGS

The features and advantages of the invention will become more apparent from the following description with respect to an embodiment as shown in appended drawings wherein.

DETAILED DESCRIPTION OF PREFERRED EMBODIMENT

Figure 1:
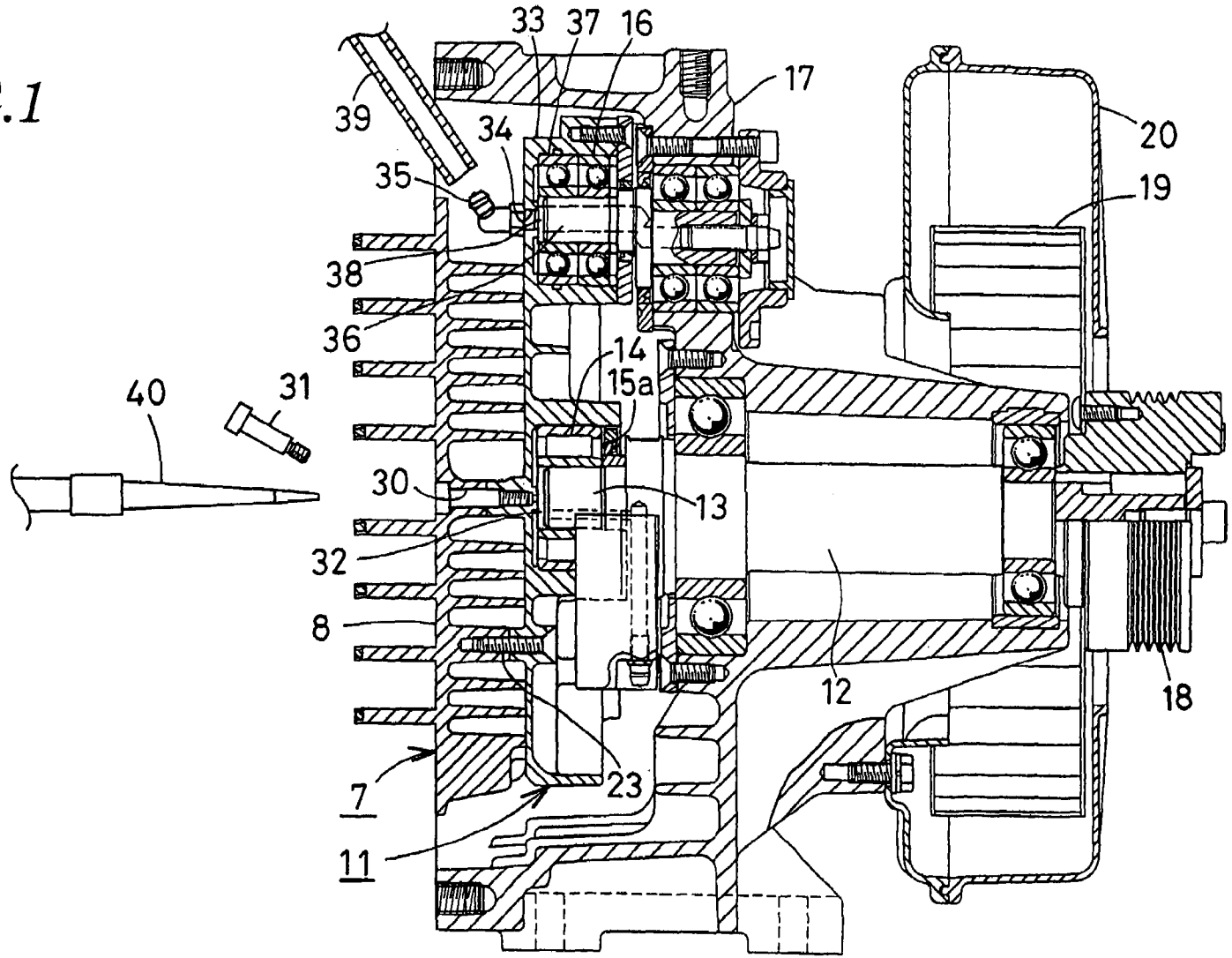
FIG. 1 is a vertical sectional side view of a scroll fluid machine according to the present invention in which a cover plate and a stationary scroll are removed.
Figure 2:
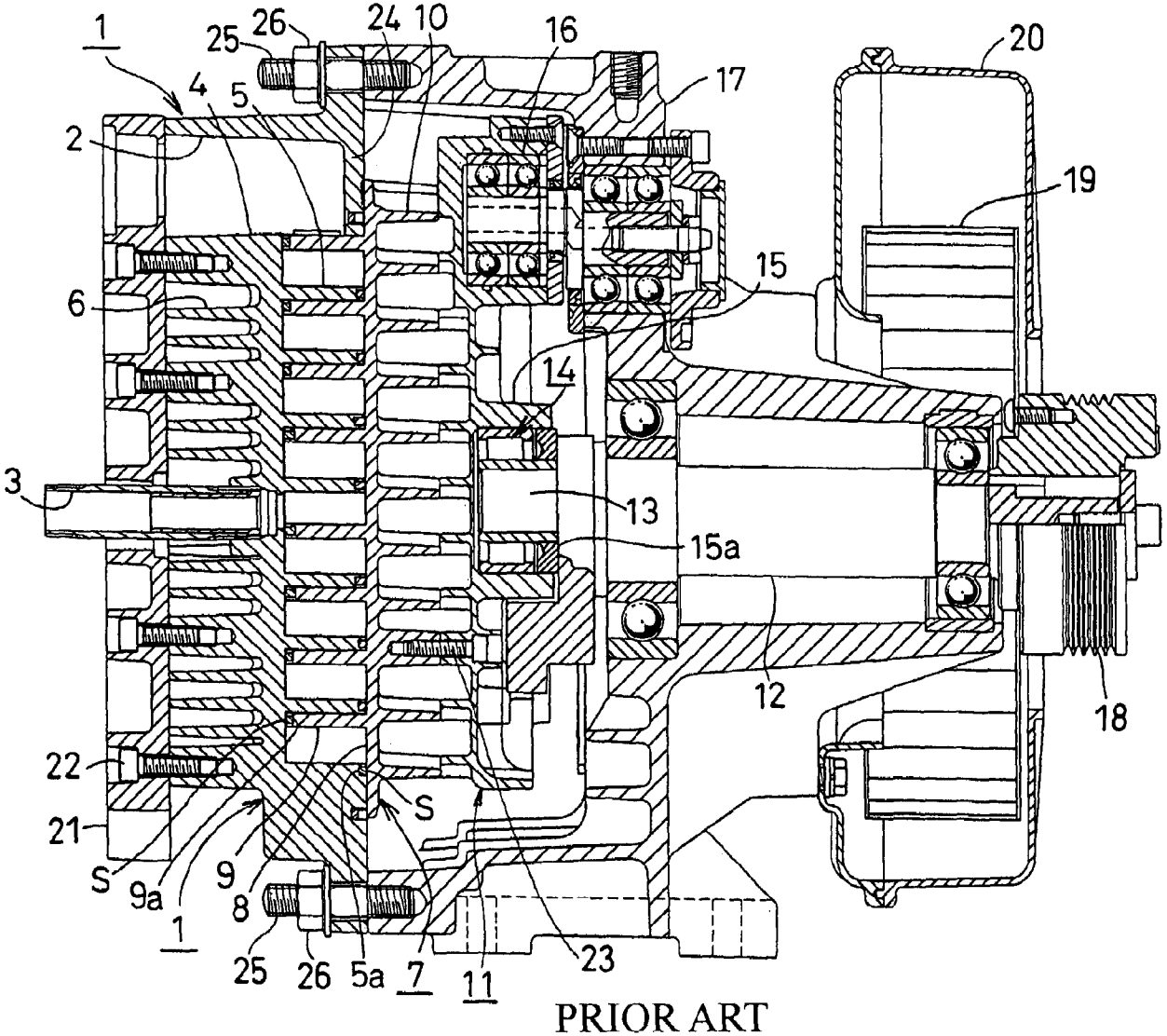
FIG. 2 is a vertical sectional side view of a known scroll fluid machine.

FIG. 1 is a vertical sectional side view of a preferred embodiment of the present invention in which the cover plate 21, the outlet 3 and the stationary scroll 1 are removed from the machine in FIG. 2.

FIG. 1 is similar to FIG. 2, and the same numerals are allotted to the same members. The description therefor is omitted.

At the center of an orbiting end plate 8 of an orbiting scroll 7 or at the center of a bearing plate 11 fixed to the orbiting scroll 7 by a screw 23, an oil-supply hole 30 is formed through the orbiting wrap 9, and a grease nipple 31 engages in the oil-supply hole 30.

A radial gap 32 is formed to reach to the front surface of a bearing 14 between the rear end of the oil-supply hole 30 and the front face of an eccentric shaft portion 13 of a drive shaft 12.

On the front face of a support boss 33 for a self-rotation preventing device 16 on the outer circumference of the bearing plate 11, an oil-supply hole 34 is formed and an inclined grease nipple 35 engages in the oil-supply hole 34.

A radial gap 38 is formed to reach to the front face of a ball bearing 37 for a pivot 36 of the self-rotation preventing device between the rear end of the oil-supply hole 34 and the front face of the pivot 36.

In FIG. 1, the grease nipples 31,35 are disposed toward the orbiting wrap 9, so that grease can easily be supplied into a rotating portion by the grease guns 39, 40 from the openings.

The foregoing merely relates to an embodiment of the invention. Various changes and modifications may be made by a person skilled in the art without departing from the scope of claims.

What is claimed is:

1. A scroll fluid machine comprising:

a drive shaft having an eccentric shaft portion at one end;

a stationary scroll comprising a stationary end plate having a stationary wrap;

an orbiting scroll comprising an orbiting end plate having an orbiting wrap, said orbiting scroll being supported around the eccentric shaft portion of the drive shaft to turn via a bearing;

a self-rotation preventing device for preventing the orbiting scroll from rotation around its own axis, the orbiting scroll being eccentrically revolved with respect to the stationary scroll while forming a sealed chamber between the stationary wrap and the orbiting wrap; and a bearing plate fixed to the orbiting scroll behind the orbiting scroll, an oil-supply hole being formed through the bearing plate in front of the self-rotation preventing device so that grease may be supplied from the oil-supply hole into a bearing of the self-rotation preventing device.

2. A scroll fluid machine as claimed in claim 1 wherein a grease nipple is attached in the oil-supply hole.

3. A scroll fluid machine as claimed in claim 1 wherein a gap is radially formed toward the bearing of the self-rotation preventing device at a rear end of the oil supply hole so that grease may be passed to the bearing.

4. A scroll fluid machine as claimed in claim 1, further comprising an oil-supply hole being axially formed through the orbiting end plate in front of the eccentric shaft portion of the drive shaft so that grease may be supplied from the oil supply hole into the bearing of the eccentric shaft portion.

* * * * *